US009311927B2

(12) United States Patent
Lei et al.

(10) Patent No.: US 9,311,927 B2
(45) Date of Patent: Apr. 12, 2016

(54) DEVICE AND METHOD FOR AUDIBLE TRANSIENT NOISE DETECTION

(75) Inventors: Zhichun Lei, Stuttgart (DE); Paul Springer, Stuttgart (DE); Frank Moesle, Stuttgart (DE); Ryota Isozaki, Kanagawa (JP); Thimo Emmerich, Stuttgart (DE)

(73) Assignee: Sony Corporation, Tokyo (JP)

( * ) Notice: Subject to any disclaimer, the term of this patent is extended or adjusted under 35 U.S.C. 154(b) by 573 days.

(21) Appl. No.: 13/348,136

(22) Filed: Jan. 11, 2012

(65) Prior Publication Data

US 2012/0201390 A1 Aug. 9, 2012

(30) Foreign Application Priority Data

Feb. 3, 2011 (EP) ..... 11153145

(51) Int. Cl.

| | |
|---|---|
| ***H04R 29/00*** | (2006.01) |
| ***G10L 21/0208*** | (2013.01) |
| *G10L 21/0224* | (2013.01) |
| *G10L 21/0232* | (2013.01) |

(52) U.S. Cl.

CPC ..... *G10L 21/0208* (2013.01); *G10L 21/0224* (2013.01); *G10L 21/0232* (2013.01); *H04R 2225/43* (2013.01)

(58) Field of Classification Search

CPC ..... G01H 3/14; G04R 29/00; G10L 21/0208; G10L 21/0232; G10L 21/0224; H04R 225/43

USPC ..... 381/56, 57, 94.1–94.3, 98, 101–103, 381/104, 106–108

See application file for complete search history.

(56) References Cited

U.S. PATENT DOCUMENTS

| | | | | |
|---|---|---|---|---|
| 3,947,636 | A | 3/1976 | Edgar | |
| 5,951,486 | A * | 9/1999 | Jenkins | A61B 5/01 600/559 |
| 2005/0102112 | A1* | 5/2005 | Reichler | B67D 7/085 702/45 |
| 2005/0171774 | A1* | 8/2005 | Applebaum | G10L 17/12 704/250 |
| 2008/0212795 | A1* | 9/2008 | Goodwin | G10L 19/025 381/94.2 |
| 2008/0261549 | A1 | 10/2008 | Altizer | |

(Continued)

FOREIGN PATENT DOCUMENTS

WO WO 2010/083879 A1 7/2010

OTHER PUBLICATIONS

U.S. Appl. No. 13/886,807, filed May 3, 2013, Springer, et al.

(Continued)

*Primary Examiner* — Vivian Chin
*Assistant Examiner* — William A Jerez Lora
(74) *Attorney, Agent, or Firm* — Oblon, McClelland, Maier & Neustadt, L.L.P.

(57) ABSTRACT

The present invention relates to a device and a corresponding method for audible transient noise detection in an audio signal. To avoid the detection of false positives or at least reduce the number of detected false positives a device is proposed comprising a detector configured to detect a set of transient noise candidates in time or frequency domain among a plurality of samples of said audio signal, and a selector configured to select audible transient noise candidates from said set of transient noise candidates by use of one or more selection criteria, wherein the selection criteria used for said selection are selected and/or whose parameters are at least partly set based on characteristics of said audio signal.

19 Claims, 9 Drawing Sheets

(56) References Cited

U.S. PATENT DOCUMENTS

2009/0112584 A1 4/2009 Li et al.
2009/0225211 A1* 9/2009 Oike ..... H03M 1/1023
348/308
2010/0290632 A1* 11/2010 Lin ..... G01S 3/8006
381/56

OTHER PUBLICATIONS

U.S. Appl. No. 13/887,021, filed May 3, 2013, Springer, et al.

* cited by examiner

DEVICE AND METHOD FOR AUDIBLE TRANSIENT NOISE DETECTION

CROSS-REFERENCE TO RELATED APPLICATIONS

The present application claims priority of European patent application 11 153 145.5 filed on 3 February 2011.

FIELD OF THE INVENTION

The present invention relates to a device and a corresponding method for audible transient noise detection in an audio signal. Further, the present invention relates to a computer program for implementing said method and to a computer readable non-transitory medium storing such a computer program.

BACKGROUND OF THE INVENTION

There are many devices and methods known for transient noise detection in an audio signal which often make use of the signal characteristics. If, however, transient noise is detected only in terms of signal characteristics, e.g. the signal spectrum, such kind of transient noise may not be hearable and the conventional detection algorithms may thus lead to false positives as those known methods and devices generally detect noise that is both hearable and not hearable by a person. Such a device and method are, for instance, described in US 2008/0261594 A1 and WO 2010/083879 A1.

In particular, WO 2010/083879 A1 discloses a hearing aid having means for detecting fast transients in the input signal and means for attenuating the detected transients prior to presenting the signal with the attenuated transients to a user. Detection is performed therein by measuring the peak difference of the signal upstream of a band split filter bank and comparing the peak difference against at least one peak difference limited.

BRIEF SUMMARY OF THE INVENTION

It is an object of the present invention to provide a device and a corresponding method for audible transient noise detection in an audio signal which avoids the detection of false positives or at least reduces the number of detected false positives, but mainly (or only) detects hearable transient noise. It is a further object of the present invention to provide a corresponding computer program for implementing said method and a computer readable non-transitory medium.

According to an aspect of the present invention there is provided a device for audible transient noise detection in an audio signal comprising:

a detector configured to detect a set of transient noise candidates in time or frequency domain among a plurality of samples of said audio signal, and a selector configured to select audible transient noise candidates from said set of transient noise candidates by use of one or more selection criteria, wherein the selection criteria used for said selection are selected and/or whose parameters are at least partly set based on characteristics of said audio signal.

According to a further aspect of the present invention there is provided a device for audible transient noise detection in an audio signal comprising:

detection means for detecting a set of transient noise candidates in time or frequency domain among a plurality of samples of said audio signal, and selection means for selecting audible transient noise candidates from said set of transient noise candidates by use of one or more selection criteria, wherein the selection criteria used for said selection are selected and/or whose parameters are at least partly set based on characteristics of said audio signal.

According to a further aspect of the present invention there is provided a method for audible transient noise detection in an audio signal comprising the steps of:

detecting a set of transient noise candidates in time or frequency domain among a plurality of samples of said audio signal, and selecting audible transient noise candidates from said set of transient noise candidates by use of one or more selection criteria, wherein the selection criteria used for said selection are selected and/or whose parameters are at least partly set based on characteristics of said audio signal.

According to still further aspects a computer program comprising program means for causing a computer to carry out the steps of the method according to the present invention, when said computer program is carried out on a computer, as well as a computer readable non-transitory medium having instructions stored thereon which, when carried out on a computer, cause the computer to perform the steps of the method according to the present invention are provided.

Preferred embodiments of the invention are defined in the dependent claims. It shall be understood that the claimed method, the claimed computer program and the claimed computer readable medium have similar and/or identical preferred embodiments as the claimed device and as defined in the dependent claims.

The present invention is based on the idea to perform the transient noise detection by first detecting transient noise candidates and then post-process the transient noise candidates and select only audible transient noise candidates. For said selection different selection criteria, sometimes also called cost functions, including the use of different parameter settings, e.g. thresholds, in the selection criteria can be applied. The selection criteria to be used and/or their settings are chosen based on the characteristics of the audio signal, said characteristics including (but are not limited to) the absolute noise level (independent from the quantization), the loudness, the relative noise level (depending on the quantization), the type of audio signal (speech, classical music, pop, rock) etc. Preferably, also the user input and/or input from an application that uses the result of the audible transient noise detection can be used in addition for the selection of the used selection criteria and/or the setting of their parameters.

Thus, compared to the known methods and devices it can be distinguished between transient noise that is hearable to a person and that is not hearable so that, for instance, not hearable transient noise can be excluded from post-processing (e.g. from subjecting it to attenuating processing) resulting in a considerable saving of processing capacity and storage space for such post-processing. This is particularly interesting for professional applications, such as video processing devices and methods, hearing aids or music restoration.

BRIEF DESCRIPTION OF THE DRAWINGS

These and other aspects of the present invention will be apparent from and explained in more detail below with reference to the embodiments described hereinafter. In the following drawings

DETAILED DESCRIPTION OF THE INVENTION

Figure 1:
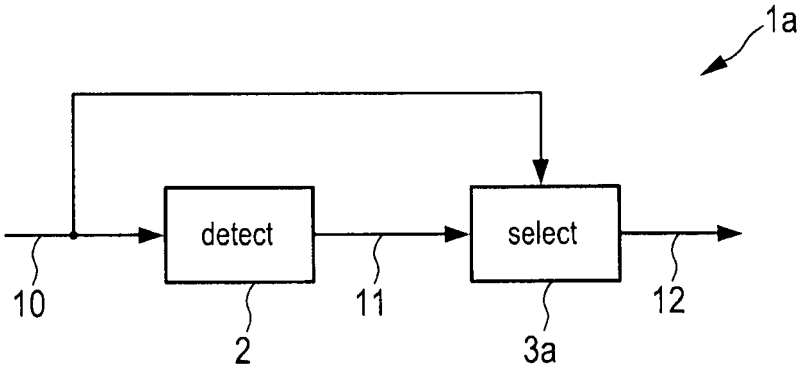
FIG. 1 shows a block diagram of a first embodiment of a device for audible transient noise detection according to the present invention.

FIG. 1 shows a block diagram of the general layout of a device 1*a* for audible transient noise detection in an audio signal 10 according to the present invention. The device 1*a* comprises a detector 2 that receives an audio signal 10 and detects a set of transient noise candidates 11 in time or frequency domain among a plurality of samples of said audio signal 10. Said transient noise candidates 11 are provided to a selector 3*a* that selects audible transient noise candidates 12 from said set of transient noise candidates 11 by comparing the absolute value and/or slope of a transient noise candidate of said set with the absolute value and/or slope of audio samples of said audio signal 10 adjacent in time to said transient noise candidate. The selected audible transient noise candidates 12 are then output from the selector 3*a* and may be used for various purposes and various applications.

In particular, in an application said audible transient noise candidates may be subjected to post-processing for attenuating said audible transient noise candidates to improve the quality of the input audio signal 10. The output from the selector 3*a* may thus be a list, for instance of time positions, at which the selected audible transient noise candidates exist in the input audio signal 10.

Figure 2:
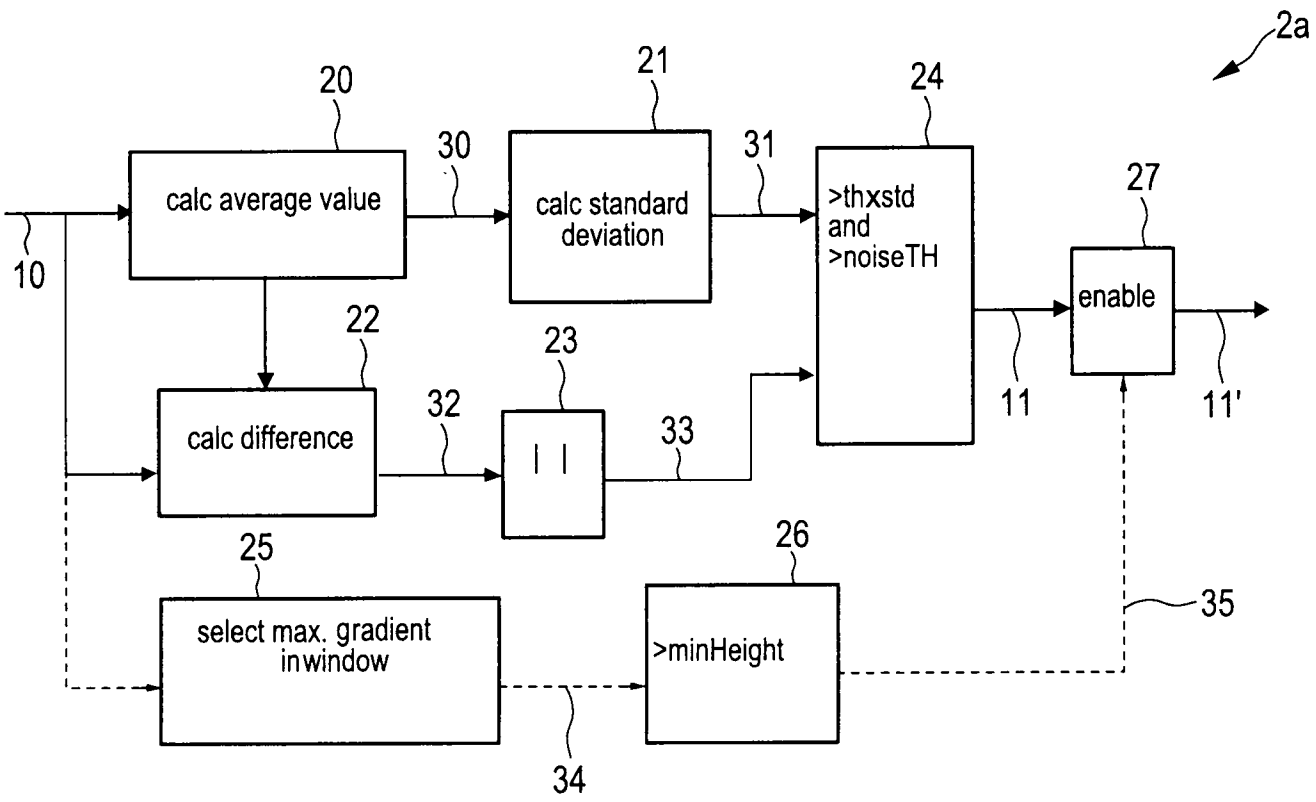
FIG. 2 shows a block diagram of a first embodiment of a detector of such a device according to the present invention.

A first embodiment of a detector 2*a* for detection of transient noise candidates in the time domain is schematically depicted in the block diagram shown in FIG. 2. First the peaks of the audio samples of the audio signal 10 are detected. As a detection criterion the standard deviation is used, which standard deviation is calculated within a window comprising a number of audio samples.

To detect the peaks of the audio samples, the average value 30 of the audio signals 10 in the window of audio samples is determined in an average value calculation unit 20, and from said average value 30 the standard deviation 31 is calculated in a standard deviation calculation unit 21. Further, the difference 32 between a sample value of an audio sample and the determined average value 30 is calculated in a difference calculation unit 22, from which difference 32 the absolute value 33 is determined in an absolute value calculation unit 23. Then, in a decision unit 24 it is determined if the absolute difference 33 between a sample value and the average value 30 is a predetermined multiple (referred to as th in FIG. 2), i.e. several times; a default setting of th being 3.5 as an example, larger than the standard deviation 31 (referred to as std in FIG. 2), and if this absolute difference 33 is larger than a predefined noise threshold noiseTH (also called noise sensitivity threshold) in a decision unit 24. If this is the case then the audio sample under consideration is considered as a transient noise candidate 11.

The parameter "th" is a constant multiplication factor of the standard deviation, which is generally set by the user, usually in the range of 3.0-5.0, e.g. 3.5. Lowering the factor will lead to more detected peaks, increasing the factor to less detected peaks. The parameter "noiseTH" (also called noise sensitivity threshold) is generally also set by user. Usually this is a negative value set in dBFS (decibel full scale) relative to the maximum possible amplitude of the signal, e.g. 0 dBFS will be signal with maximum amplitude, and −98 dBFS will be the minimum non-zero amplitude for 16 bpp signals. dBFS can be directly converted into absolute amplitude levels ranging e.g. from 0-255 for 8-bit-quantized signals. A dBFS value closer to zero (=larger amplitude) will lead to less detected peaks, a very negative dBFS value (=smaller amplitude) will lead to more detected peaks.

Optionally, as indicated by the dashed lines in FIG. 2, the detector 2*a* comprises further elements and is thus configured to determine a maximum gradient value for a number of subsequent audio samples, in particular the audio samples in the window under examination. It considers an audio sample as a transient noise candidate if said maximum gradient value exceeds a minimal height threshold. In particular, in a maximum gradient selection unit 25 the maximum gradient value 34 is selected within the window, e.g. of length 3. This maximum gradient value 34 is then compared in a comparison unit 26 to a minimal height threshold value minHeight). The minimal height threshold value "minHeight" can be set by the user. It is usually set to half of the whole slope height (either increasing slope or decreasing scope). Lowering this will lead to more detected peaks and vice-versa.

If the maximum gradient value is larger than said minimum height threshold value, as may be indicated by an enabling signal 35, the transient noise candidate 11 that has been determined in parallel is then enabled by an enabling unit 27 and is output as enabled transient noise candidate 11'. Otherwise, the transient noise candidate 11 will be annulled (i.e. not output). It shall be noted that the minimum height threshold value generally depends on the quantization level and may, for instance, be determined by the human auditory system.

Figure 3:
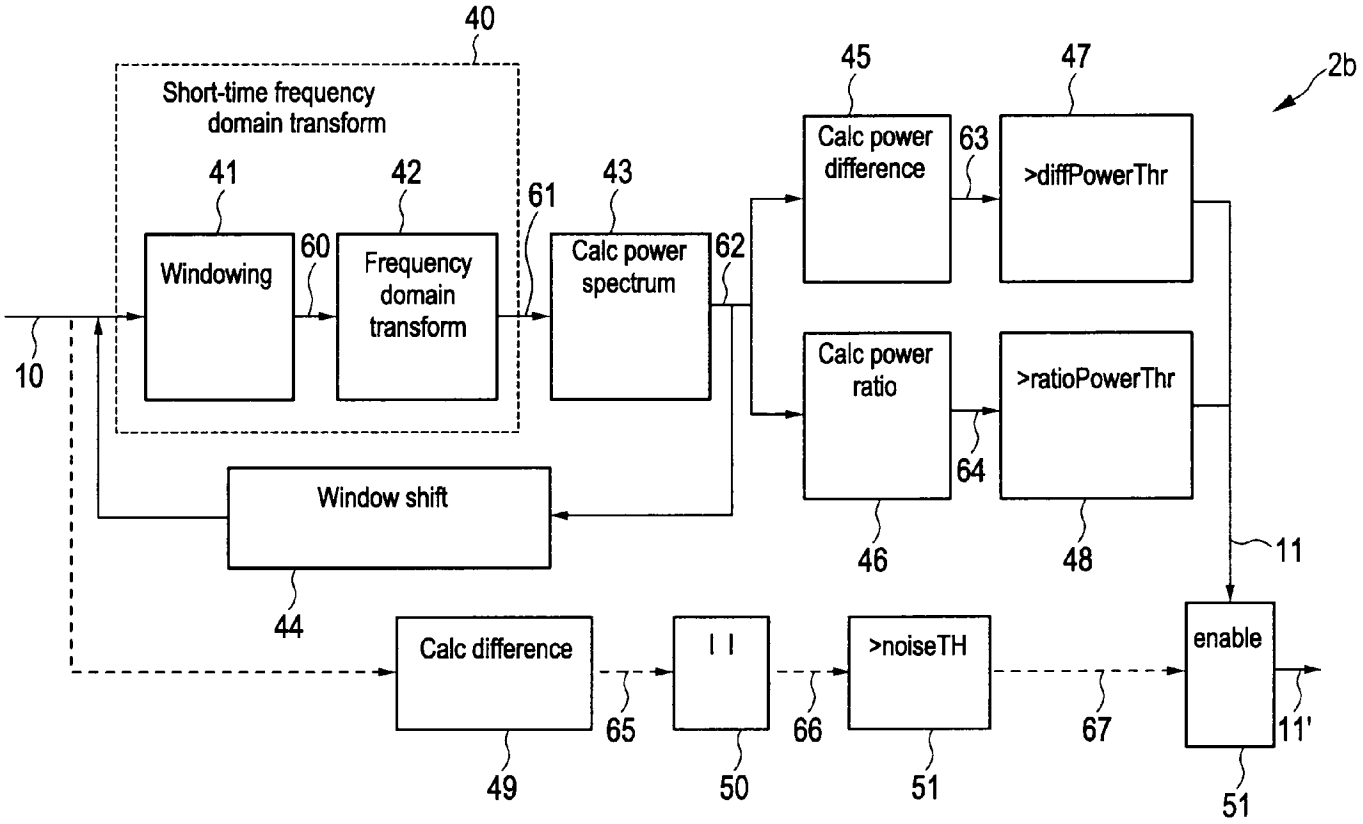
FIG. 3 shows a block diagram of a second embodiment of a detector of such device according to the present invention.

A second embodiment of a detector 2*b* for detection of transient noise candidates in the frequency domain is schematically depicted in the block diagram shown in FIG. 3. First, in a transformation unit 40 a short-time frequency domain transform is performed. In particular, at first the audio samples 10 are windowed in a windowing unit 41 by use of window function, e.g. a Hanning window, and a window width, e.g. 1024. Further, the windowed samples 60 are transformed in a transformation unit 42 from time domain to frequency domain by use of a discrete frequency domain transform, e.g. a Fast Fourier Transform (FFT). Subsequently, in a power spectrum calculation unit 43 the power spectrum 62 is calculated from this FFT result 61. By use of a window shift unit 44 the window is shifted by a shift width, e.g. 200, and the same processing is repeatedly performed.

Next, from the power spectrum 62 the power difference 63 and the power ratio 64 are calculated between the current power spectrum 62 and the previous one in a power difference calculation unit 45 and a power ratio calculation unit 46, respectively. In a first comparison unit 47 the calculated power difference is compared to a power difference threshold (referred to as diffPowerThr, e.g. 1), and in a second comparison unit 48 the power ratio is compared to a power ratio threshold (referred to as ratioPowerThr, e.g. 10). This means that if the power difference is larger than the power difference threshold (diffPowerThr) and if the power ratio is larger than the power ratio threshold (ratioPowerThr), then the windowed area of the audio samples includes transient noise, i.e. transient noise candidates 11 are issued (or the audio samples in the windowed area are considered as including transient noise candidates).

The value for diffPowerThr may be any value larger than zero, typically 1. A lower value leads to more detected transient noise candidates, a higher value leads to less detected transient noise candidates. The value for ratioPowerThr may be any value larger than 1, typically 10. A lower value leads to more detected transient noise candidates, a higher value leads to less detected transient noise candidates. Both values can be set by the user, either to a fixed value (e.g. the proposed ones), or different depending on the type of signal (as explained above) or its characteristics.

Optionally, as indicated by the dashed lines in FIG. 3, a difference calculation unit 49 is provided (similar to the difference calculation unit 22 of the embodiment shown in FIG. 2) which calculates the difference 65 between a sample value of a current audio sample and the average value of the audio samples within a window, which is usually the same window as used for standard deviation calculation. To give an example, this window could be of size 128 as mentioned above. From this difference 65 the absolute value 66 is determined in an absolute value calculation unit 50. Then, in a decision unit 51 it is determined if the absolute difference 66 is larger than a predefined noise threshold (noiseTH). If this is the case, as indicated by the decision signal 67, then the audio sample under consideration is considered as a transient noise candidate, i.e. the transient noise candidate 11 that has been determined in parallel as explained above is enabled by the enabling unit 51 and is output as enabled transient noise candidate 11'.

It shall be noted that the various thresholds mentioned above may generally be set by the user and may thus be predetermined. These thresholds may also be different from application to application and may have an influence on the sensitivity of the detection of transient noise candidates. The particular values or ranges that may be used are often found empirically or by simulation, or may be set after a trial and error phase and a monitoring of the respective results of the detection.

Figure 4:
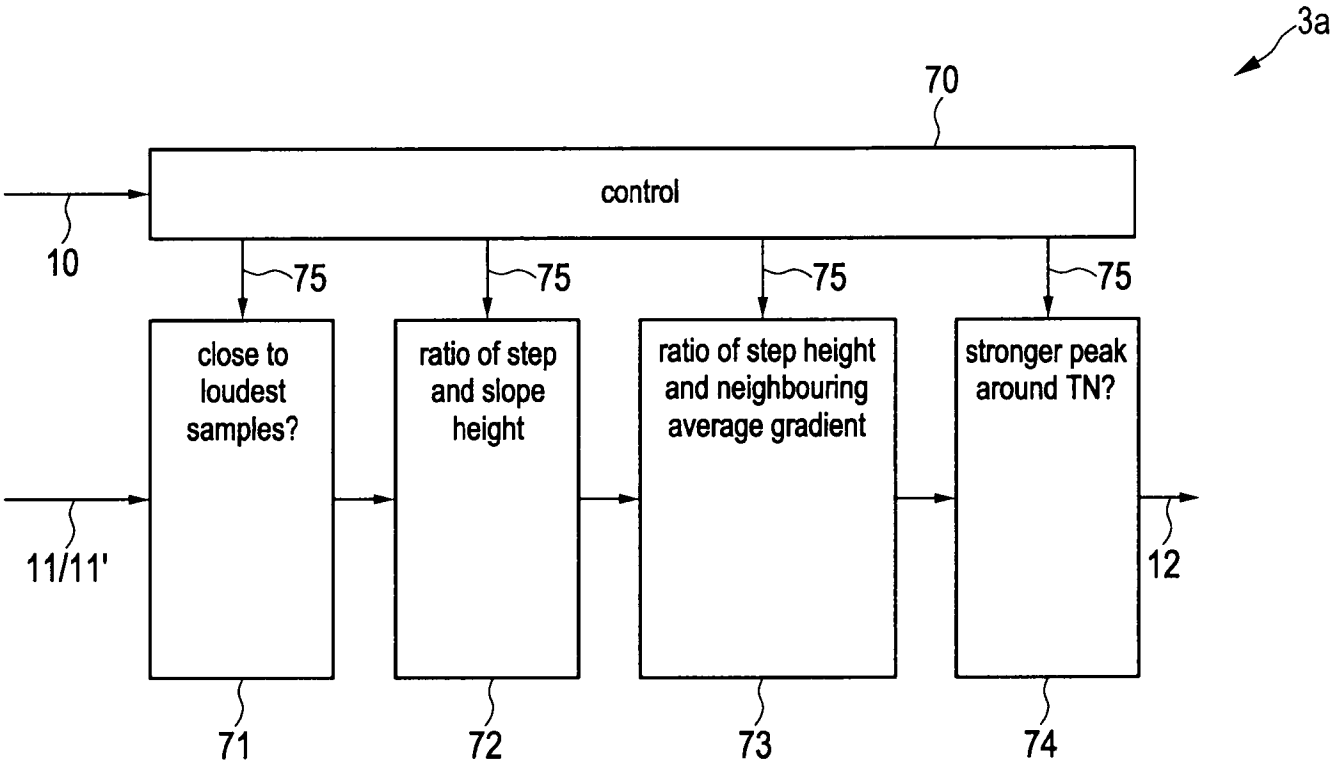
FIG. 4 shows a block diagram of a first embodiment of a selector of such a device according to the present invention.
Figure 5:
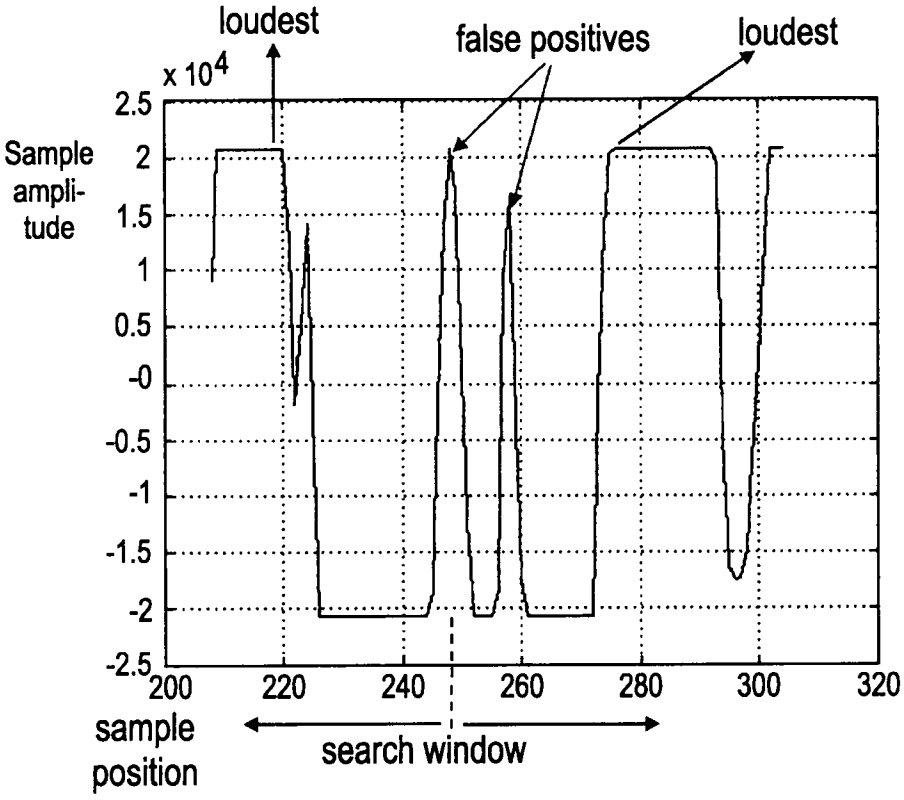
FIG. 5 shows a diagram illustrating a first embodiment of a selector according to the present invention.

The detected transient noise candidates are subsequently subjected to a selection processing by which the audible transient noise candidates are identified so that they can be distinguished from non-audible transient noise candidates, e.g. subjected to different post-processing. In said selection various selection criteria may be applied. An embodiment of such a selector 3*a* is schematically depicted in FIG. 4. Said selector 3*a* comprises various selection sub-units 71 to 74 each being adapted for applying a certain selection criterion, which selection criteria will be explained below one after the other with reference to FIGS. 5 to 8.

Further, a control unit 70 is provided for controlling said selection subunits 71-74 according to the characteristics of the audio signal 10, e.g. based on the noise level or audio loudness of the audio samples of the audio signal 10. Thus, under control of control signals 75 issued by said control unit 70 different selection criteria (also called cost functions) are applied and/or different threshold values (or other parameter settings) used by said various selection sub-units 71-74 for the selection of the audible transient noise candidates are used.

In an embodiment all selection criteria must collectively be fulfilled for selecting a transient noise candidate as an audible transient noise candidate. However, in other embodiments only one or more of said selection criteria are selectively checked or the selection criteria can be individually switched on and off by the control unit 70 so that only the selected selection criteria must be fulfilled for selecting a transient noise candidate as an audible transient noise candidate.

In the selection sub-unit 71 it is checked if the loudest audio sample lasts more than n (e.g. 3) samples (wherein n may be selected from a large range, in particular $2 \leq n \leq 200$) before and after a transient noise candidate. If this is the case the respective transient noise candidate will be annulled because it is not hearable by the human auditory system. This is for instance the case for the peaks shown in FIG. 5 indicated as "false positives". Such transient noise candidates (false positives) are masked by the loudest audio samples appearing in close proximity so that these transient noise candidates are not hearable. Amplitudes of the loudest audio samples may vary to some extent, e.g. by 10%. Further, it shall be noted that this selection criterion is generally only used in case of a high noise sensitive threshold value.

Thus, the selection sub-unit 71 is adapted to check as a selection criterion if the transient noise candidate is arranged close in time to a loudest audio sample, in particular arranged within a search window covering a predetermined number of audio samples around said transient noise candidate.

Figure 6B:
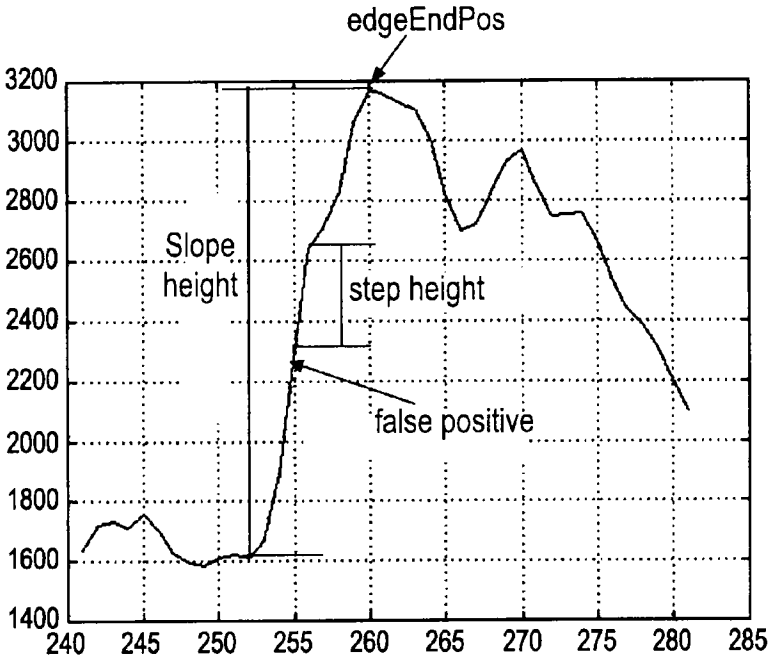
FIG. 6 shows diagrams illustrating a second embodiment of a selector according to the present invention.
Figure 6A:
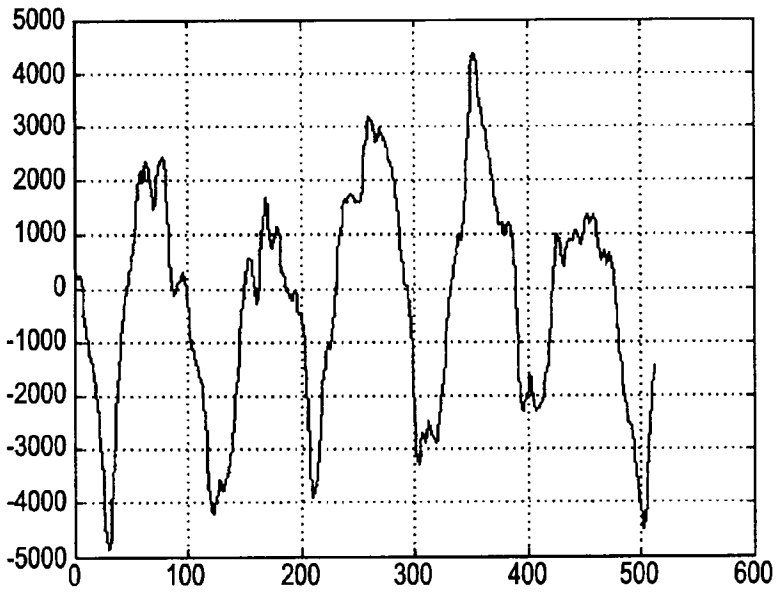

Sometimes the amplitude of the audio samples increases or decreases monotonously. The beginning and end position of the monotonous increasing or decreasing slope is determined in the selection sub-unit 72. Then, the maximum absolute gradient value on the slope is calculated as well as the height of the slope. If the ratio of the maximum gradient value divided by the height of the slope is less than a ratio threshold, e.g. 0.5, and the transient noise candidate position does not coincide with the slope end position, such a transient noise is considered as not hearable. Hence, this transient noise candidate will be annulled. This is also illustrated by the diagrams shown in FIG. 6, wherein FIG. 6B shows an enlarged view of part of the signal shown in FIG. 6A.

From the slope beginning and end position it is also possible to calculate the width of the slope. The slope width decreases by 1 each time if the absolute gradient value is less than a certain percentage, e.g. 5%, of the maximum absolute value. If the final slope width is not less than a slope width threshold, e.g. 3, and the noise sensitivity threshold is not high, the transient noise candidate position will be annulled. If, however, a high noise sensitivity threshold value is used, e.g. specified by the user, such as a noise sensitive threshold value above 40, then said width criterion is preferably not used.

In the selection sub-unit 72 the slope beginning and end position is detected for getting the slope height. The difference of end and beginning position is the width of the slope, counted in audio samples, e.g. 10 for a 10-sample-wide slope. The slope width decreases by 1 each time if the absolute gradient value is less than a certain percentage, e.g. 5%, of the maximum absolute value. For example in the 10-sample example, if the gradient between the first two samples is less than 5% of the maximum gradient amplitude of all the slope, the first sample is excluded from the slope and the width is reduced to 9. The reason for this is the wish to exclude very slowly changing and thus not relevant parts of the slope.

Figures 7A, 7B:
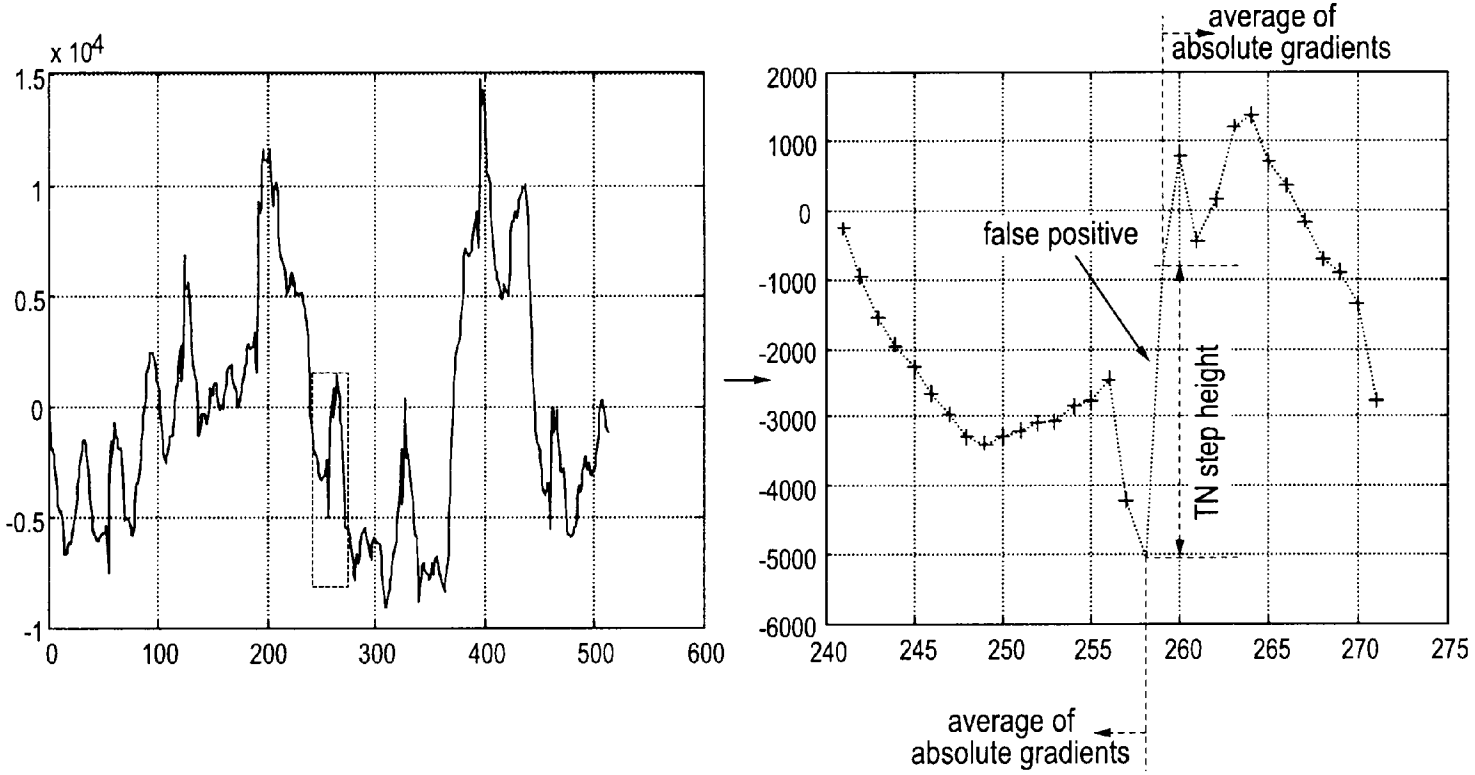
FIG. 7 shows diagrams illustrating a third embodiment of a selector according to the present invention.

In the selection sub-unit 73 some samples in front of a slope begin position and some samples behind a slope end position are evaluated. For instance, in an embodiment typically ten samples in front of and ten samples behind the slope are evaluated. For simplicity, the absolute gradients in front of the slope begin position as well as the sum of the absolute gradients after the slope end position are summed up, respectively. The smaller one of the sum values is selected. Then the maximum gradient value (34 in FIG. 2) is divided by the smaller sum value. If the division result is smaller than a predefined threshold, and the slope begin position does not coincide with the transient noise candidate position subtracted by 1, and if the slope end position does not coincide with a noise candidate position added by 1, such transient noise is not bearable so that the transient noise candidate will be annulled. This is illustrated in FIG. 7, wherein FIG. 7B shows an enlarged view of part of the signal shown in FIG. 7A.

In an alternative embodiment, instead of the sum of the absolute gradients, it is also possible to compute, for instance, the standard deviation of a number of audio samples in front of a slope begin position and behind a slope end position and select the smaller standard deviation of said first and second standard deviations. Said smaller standard deviation is then used to divide the maximum of the gradient value of said slope by the smaller standard deviation, whereafter it is checked if the divisional result exceeds a second gradient threshold.

Figure 8B:
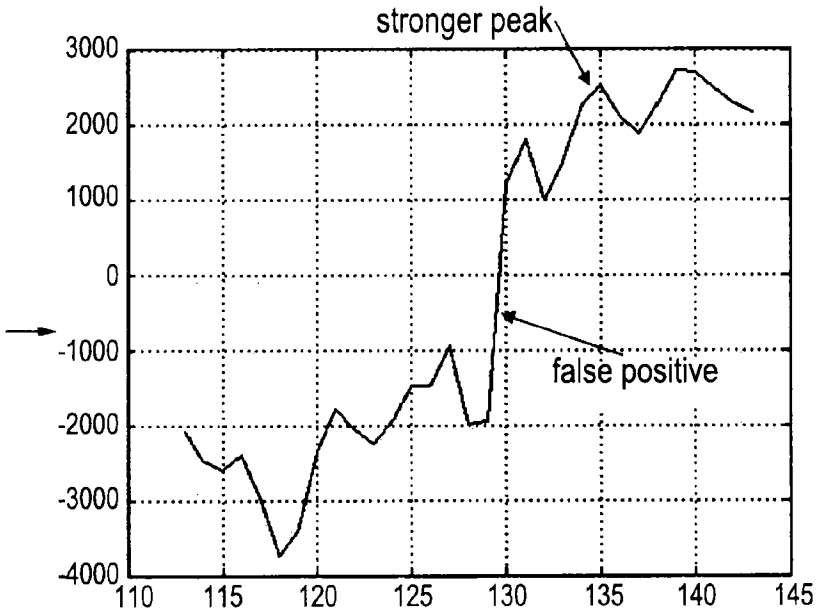
FIG. 8 shows diagrams illustrating a fourth embodiment of a selector according to the present invention.
Figure 8A:
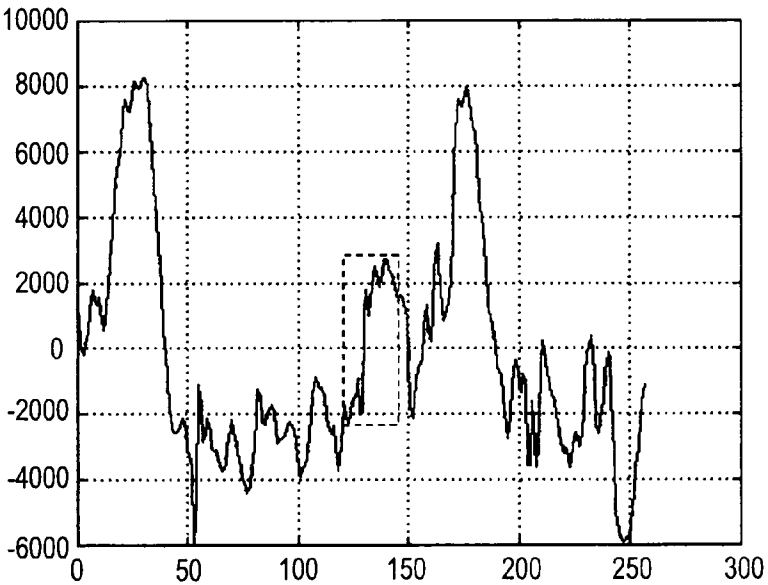

In the selective sub-unit 74 around a transient noise candidate is checked whether there is a stronger peak. If there is a stronger peak, the transient noise candidate will be annulled. This is illustrated in FIG. 8 wherein FIG. 8B shows an enlarged view of part of the signal shown in FIG. 8A. If a high noise sensitivity threshold value is specified, e.g. 40, this selection criterion is preferably not used.

Figure 9:
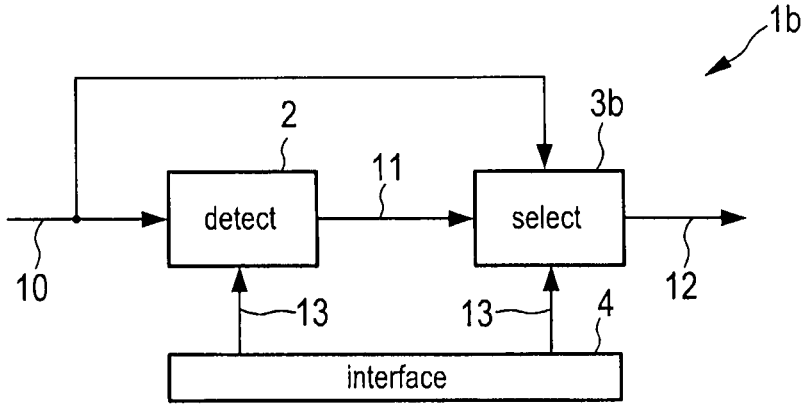
FIG. 9 shows a block diagram of a second embodiment of a device for audible transient noise detection according to the present invention.

Another embodiment of a device 1*b* for audible transient noise detection in an audio signal 10 according to the present invention is schematically depicted in FIG. 9. According to this embodiment an additional interface 4 is provided. The interface 4 is thus generally coupled to the detector 2 and the selector 3*b* and provides them with the input information 13 received at the interface 4. The input information 13 is generally provided for influencing the detection of transient noise candidates in the detector 2 and/or the selection of audible transient noise candidates in the selector 3*b*.

The interface 4 is adapted, in one embodiment, as a user interface via which the user may input user settings, such as the sensitivity, the noise level and/or the accuracy of the detection and/or the selection. This input information is then used by the detector 2 and the selector 3*b*, respectively, to control the settings of the detector 2 and the selector 3*b*. If all the selection sub-units (selection criteria) are enabled, the system will only detect a small number of peaks. By disabling some selection criteria, the number of peaks will be higher. Also for most thresholds, decreasing the threshold values will lead to a higher number of peaks.

Generally, the user has no direct control of the settings in the detector and the selector. However, in a more elaborate embodiment the user may directly control the settings of selected (or all) parameters of the detector and/or the selector. For instance, in an embodiment the user may directly control which selection criteria to use in the selector 3*b* and which not, and/or may directly set certain thresholds of the selection criteria.

The interface 4 is adapted, in another embodiment, as an application interface, i.e. to which an application can be coupled for inputting information from an application that, for instance, makes use of the audible transient noise candidates 12, such as an audio restoration application. Similar as explained above for the embodiment of the interface 4 as user interface the input information 13 provided by an application may include settings, such as the sensitivity, the noise level and/or the accuracy of the detection and/or the selection. In still another embodiment the interface 4 may be adapted for both receiving user input and application input.

Figure 10:
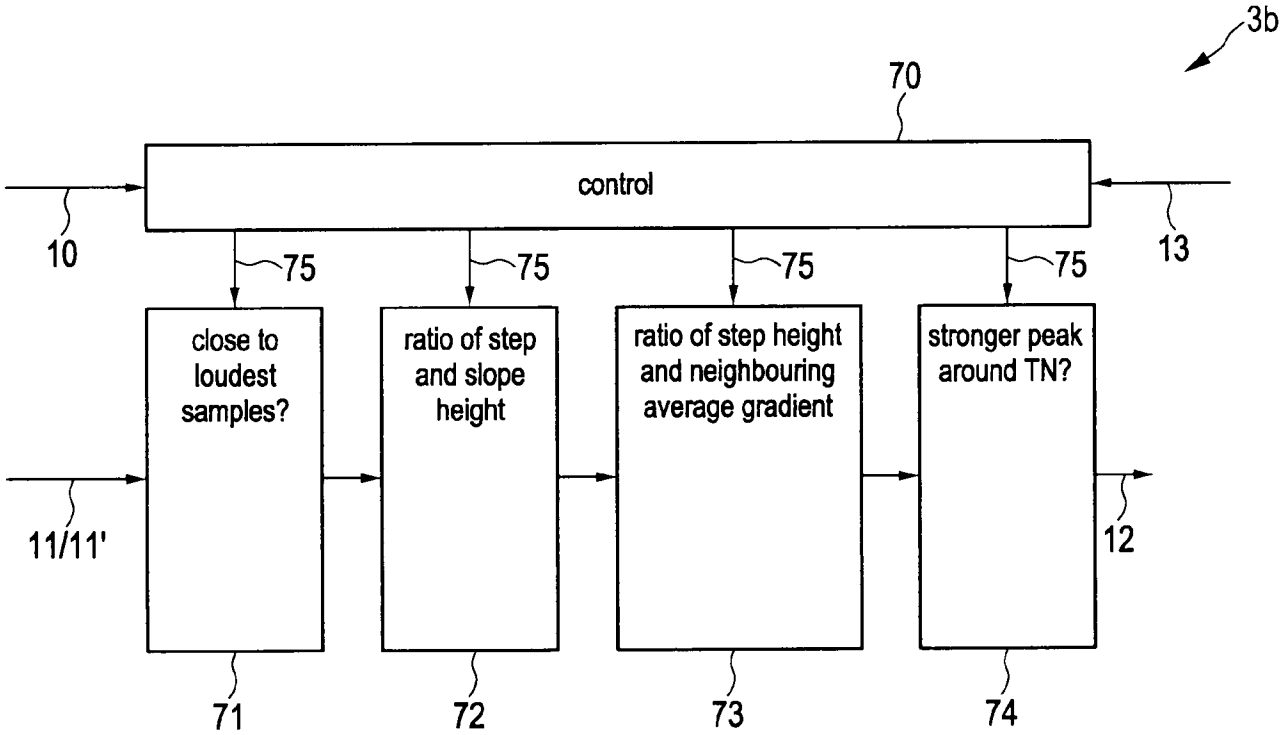
FIG. 10 shows a block diagram of a second embodiment of a selector according to the present invention.

FIG. 10 shows another embodiment of a selector 3*b* as used in the embodiment of the device 1*b* shown in FIG. 9. In this embodiment the control unit 70 includes an additional input for receiving the input information 13 which is used, in addition to the characteristics of the audio signal 10 for controlling the said selection sub-units 71-74 as generally explained above with reference to FIG. 4. Thus, the input information 13 may have an influence on the selection which selection criteria shall be used and/or which settings (e.g. thresholds) shall made in the used selection criteria for selecting the audible transient noise candidates.

Thus, according to the present invention the characteristics of the human auditory system are taken into account. In particular, after identification of transient noise candidates, in particular by finding peaks in time or frequency domain, one or more selection criteria may be applied. Preferably, depending on the characteristics of the audio signal in question, e.g. absolute noise level, audio loudness, relative noise level, type of audio signal, and also on the desired application and/or the desired sensitivity, different transient noise selection criteria (also called cost functions) are applied, i.e. not only different threshold values for cost functions but also different cost functions themselves can be applied according to the present invention. These selection criteria include, but are not limited to, checking whether there are louder samples in front of or behind the transient noise candidate position, checking the ratio of the maximum absolute gradient on a monotonous slope to the whole slope height, checking the slope width, checking the samples in front of or behind the transient noise candidate position, e.g. sum the absolute gradients, and checking the minimum absolute step height. In this way much less or even no false positives are finally detected as transient noise, but mainly hearable transient noise is detected according to the present invention.

The invention has been illustrated and described in detail in the drawings and foregoing description, but such illustration and description are to be considered illustrative or exemplary and not restrictive. The invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

A computer program may be stored/distributed on a suitable non-transitory medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. A device for audible transient noise detection in an audio signal comprising:

a memory; and at least one processor configured to detect a set of transient noise candidates in time or frequency domain among a plurality of samples of said audio signal, and select audible transient noise candidates from said set of transient noise candidates by use of one or more selection criteria, wherein the selection criteria used for said selection are selected and/or whose parameters are at least partly set based on characteristics of said audio signal, wherein said at least one processor is configured to check as a selection criterion if the transient noise candidate is arranged close in time to a loudest audio sample, in particular arranged within a search window covering a predetermined number of audio samples around said transient noise candidate, and wherein said at least one processor is configured to select audible transient noise candidates based on a comparison of the absolute value and slope of a transient noise candidate of said set with the absolute value and slope of audio samples of said audio signal adjacent in time to said transient noise candidate.

2. The device as claimed in claim 1, wherein said at least one processor is configured to apply two or more selection criteria for selecting audible transient noise candidates.

3. The device as claimed in claim 2, wherein said at least one processor is configured to check all selection criteria which must collectively be fulfilled for selecting a transient noise candidate as an audible transient noise candidate.

4. The device as claimed in claim 2, wherein said at least one processor is configured to selectively check one or more of said selection criteria, wherein only the selected selection criteria must be fulfilled for selecting a transient noise candidate as an audible transient noise candidate.

5. The device as claimed in claim 1, wherein said at least one processor further controls the selection of the used selection criteria and/or the setting of at least part of the parameters of the used selection criteria based on characteristics of said audio signal.

6. The device as claimed in claim 1, further comprising:

an interface for inputting user input and/or application input for use in the selection of the used selection criteria and/or the setting of at least part of the parameters of the used selection criteria and/or for use in the setting of at least part of the detected parameters.

7. The device as claimed in claim 1, wherein said at least one processor is configured to determine a slope height of a slope of said audio signal, to determine the maximum absolute gradient value of said slope, determine the ratio between said maximum absolute gradient value and said slope height and check as a selection criterion if the ratio exceeds a ratio threshold and if said transient noise candidate coincides with the slope end position.

8. The device as claimed in claim 1, wherein said at least one processor is configured to determine a slope width of a slope of said audio signal and to check as a selection criterion if the detected slope width exceeds a slope width threshold.

9. The device as claimed in claim 1, wherein said at least one processor is configured to determine a first sum of absolute gradients of a number of audio samples in front a slope begin position, determine a second sum of absolute gradients of a number of audio samples behind a slope end position, select the smaller sum of said first and second sums, divide the maximum absolute gradient value of said slope by said smaller sum and check as a selection criterion if the division result exceeds a first gradient threshold.

10. The device as claimed in claim 1, wherein said at least one processor is configured to determine a first standard deviation of a number of audio samples in front a slope begin position, determine a second standard deviation of a number of audio samples behind a slope end position, select the smaller standard deviation of said first and second standard deviations, divide the maximum absolute gradient value of said slope by said smaller standard deviation and check as a selection criterion if the division result exceeds a second gradient threshold.

11. The device as claimed in claim 9 or 10, wherein said at least one processor is further configured to check if the slope begin position does not coincide with the transient noise candidate position subtracted by a predetermined amount and if the slope end position does not coincide with a noise candidate position added by a predetermined amount.

12. The device as claimed in claim 1, wherein said at least one processor is configured to check as a selection criterion if around the transient noise candidate, in particular arranged within a search window covering a predetermined number of audio samples around said transient noise candidate, there is arranged an audio sample having a higher absolute value than said transient noise candidate.

13. The device as claimed in claim 1, wherein said at least one processor is configured to determine the average value and the standard deviation of a number of subsequent samples, and consider an audio sample as a transient noise candidate if the absolute difference between a sample value and said average value exceeds a predetermined multiple of said standard deviation and if said absolute difference exceeds a noise threshold.

14. The device as claimed in claim 13, wherein said at least one processor is configured to determine a maximum gradient value for a number of subsequent audio samples and to consider an audio sample as a transient noise candidate if said maximum gradient value exceeds a minimal height threshold.

15. Device as claimed in claim 1, wherein said at least one processor is configured to transform sets of audio sample, each set comprising a number of subsequent audio samples and subsequent sets comprising at most partly the same audio samples, from time domain to frequency domain to obtain a frequency spectrum for each set, determine the power spectrum of a frequency spectrum, and consider a set as comprising a transient noise candidate if the power difference between said set and a subsequent or a previous set exceeds a power difference threshold and if the power ratio between said set and a subsequent or a previous set exceeds a power ratio threshold.

16. Device as claimed in claim 15, wherein said at least one processor is configured to determine the average value of a number of subsequent samples of said set considered as comprising a transient noise candidate and to consider an audio sample of said set as a transient noise candidate if the absolute difference between a sample value and said average value exceeds a noise threshold.

17. A method for audible transient noise detection in an audio signal comprising the steps of:

detecting a set of transient noise candidates in time or frequency domain among a plurality of samples of said audio signal, and selecting audible transient noise candidates from said set of transient noise candidates by use of one or more selection criteria, wherein the selection criteria used for said selection are selected and/or whose parameters are at least partly set based on characteristics of said audio signal, wherein the selecting includes checking as a selection criterion if the transient noise candidate is arranged close in time to a loudest audio sample, in particular arranged within a search window covering a predetermined number of audio samples around said transient noise candidate, and wherein said selecting includes selecting audible transient noise candidates based on a comparison of the absolute value and slope of a transient noise candidate of said set with the absolute value and slope of audio samples of said audio signal adjacent in time to said transient noise candidate.

18. A device for audible transient noise detection in an audio signal comprising:

detection means for detecting a set of transient noise candidates in time or frequency domain among a plurality of samples of said audio signal, and selection means for selecting audible transient noise candidates from said set of transient noise candidates by use of one or more selection criteria, wherein the selection criteria used for said selection are selected and/or whose parameters are at least partly set based on characteristics of said audio signal, wherein the selecting includes checking as a selection criterion if the transient noise candidate is arranged close in time to a loudest audio sample, in particular arranged within a search window covering a predetermined number of audio samples around said transient noise candidate, and wherein said selecting includes selecting audible transient noise candidates based on a comparison of the absolute value and slope of a transient noise candidate of said set with the absolute value and slope of audio samples of said audio signal adjacent in time to said transient noise candidate.

19. A non-transitory computer-readable medium having instructions stored thereon which, when carried out on a computer, cause the computer to perform the steps of the method as claimed in claim 17.

* * * * *